US007564002B2

(12) United States Patent
Watanabe

(10) Patent No.: US 7,564,002 B2
(45) Date of Patent: Jul. 21, 2009

(54) ELECTROMECHANICAL DEVICE FOR CONTROLLING AN IMAGE FORMING APPARATUS

(75) Inventor: Hayato Watanabe, Hiratuka (JP)

(73) Assignee: Ricoh Company Ltd., Tokyo (JP)

( * ) Notice: Subject to any disclaimer, the term of this patent is extended or adjusted under 35 U.S.C. 154(b) by 83 days.

(21) Appl. No.: 11/481,818

(22) Filed: Jul. 7, 2006

(65) Prior Publication Data

US 2007/0007113 A1 Jan. 11, 2007

(30) Foreign Application Priority Data

Jul. 7, 2005 (JP) ..... 2005-198304

(51) Int. Cl.
*H01H 13/70* (2006.01)

(52) U.S. Cl. ..... 200/344; 200/341; 200/520

(58) Field of Classification Search ..... 200/341–345, 200/5 A, 520, 521, 296, 302.1, 302.2, 314
See application file for complete search history.

(56) References Cited

U.S. PATENT DOCUMENTS 4,689,455 A * 8/1987 Watanabe ..... 200/534
5,763,841 A * 6/1998 Hasunuma ..... 200/5 A
RE36,349 E * 10/1999 Matsumiya et al. ..... 200/6 A
6,027,267 A * 2/2000 Yokobori ..... 200/343
7,129,433 B2 * 10/2006 Tokusashi ..... 200/344
2006/0108210 A1 * 5/2006 Katayama et al. ..... 200/296

FOREIGN PATENT DOCUMENTS

JP 07-085751 3/1995
JP 2004119238 A * 4/2004

* cited by examiner

*Primary Examiner*—Elvin G Enad
*Assistant Examiner*—Marina Fishman
(74) *Attorney, Agent, or Firm*—Oblon, Spivak, McClelland, Maier & Neustadt, P.C.

(57) ABSTRACT

An electromechanical device including a key top member (i.e., a push button cover device) used in a push button mechanism. The key top member has a main body, a frame surrounding the main body, and a hinge portion supporting the key top main body. The hinge portion is formed integrally to the frame. The electromechanical device can be used in an operation panel of an image forming apparatus. The hinge and the main body are less susceptible to breakage during transport, installation and maintenance because they are surrounded by the frame.

10 Claims, 11 Drawing Sheets

ELECTROMECHANICAL DEVICE FOR CONTROLLING AN IMAGE FORMING APPARATUS

BACKGROUND OF THE INVENTION

1. Field of the Invention

The present invention relates to an electromechanical device for controlling an image forming apparatus. The electromechanical device includes a key top member (i.e., a push button cover device), a push button mechanism/actuator, and an operation panel.

2. Description of the Related Art

Conventionally, an image forming apparatus such as a copier or a printer includes an operation panel for inputting instructions. The instructions are input to the image forming apparatus by using a push button which moves a tactile switch that is formed on a board in the operation panel. The push button is set within an aperture, hole or recess formed on a top board of the operation panel. The push button is installed from a bottom side of the top board. In general, these push buttons are integrally formed with a hinge mechanism for tilting and a biasing mechanism for biasing movement in a predetermined direction. The push buttons are generally formed by injection molded plastic.

However, because the injection molded plastic of the hinge mechanism or the biasing mechanism is delicate, these mechanisms are easily damaged during transportation, assembly, maintenance or repair.

SUMMARY OF THE INVENTION

It is an object of the present invention to solve the above-mentioned problems. It is another object of the present invention to provide a key top member (push button cover device) which is easy to handle, install and remove. It is still another object of the invention to provide a push button mechanism which is easier and less expensive to produce, resulting in an improved yield and reduced production cost.

One embodiment of the invention includes a key top member (push button cover device) used in a push button mechanism which has a key top main body, a frame surrounding the key top main body, and a hinge portion supporting said key top main body. The hinge is formed integrally to the frame. The hinge and the key top main body are less susceptible to damage because they are surrounded by the frame. Another embodiment includes a push button mechanism including the above mentioned key top member. Another embodiment includes an operation panel that includes the above-mentioned push button mechanism. Another embodiment includes an image forming apparatus operation panel that includes the above-mentioned operation panel.

BRIEF DESCRIPTION OF THE DRAWINGS

A more complete application of the invention and many of the attendant advantages thereof will be readily obtained as same becomes better understood by reference to the following detailed description when considered in connection with the accompanying drawings, where in:

FIG. 3 (B) is a side elevation showing a cover 22 of the operation panel 20 shown in FIG. 2.

FIG. 8 (B) is a plane view or top view showing the key top member 30 in FIG. 6.

FIG. 10 (B) is a side elevation showing a base 21 of operation panel 20 in FIG. 2.

FIG. 11 (B) is a sectional view showing cross-section view of FIG. 2 along the line B-B.

FIG. 11 (C) is a sectional view showing cross-section view of FIG. 2 along the line C-C.

DESCRIPTION OF THE PREFERRED EMBODIMENT

Figure 1:
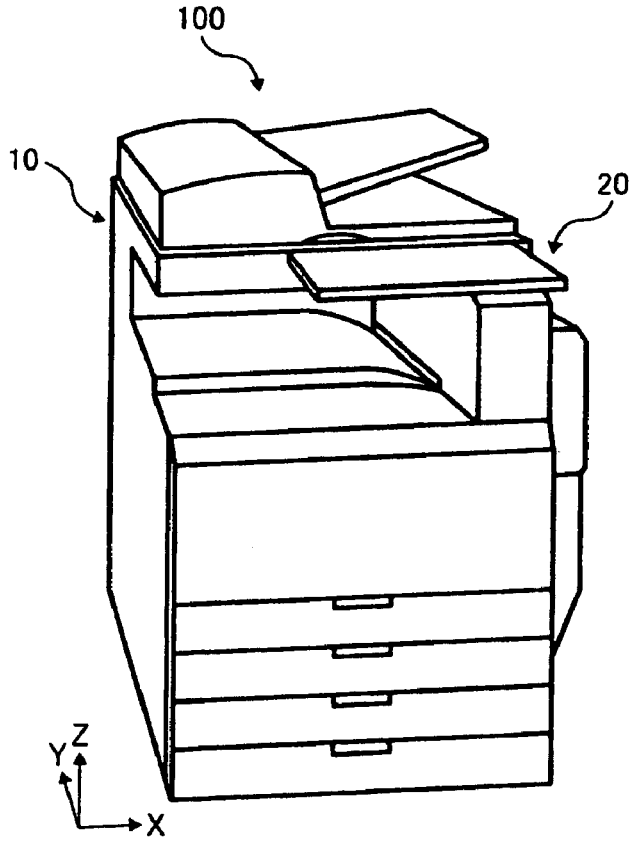
FIG. 1 is an outside drawing showing copier 100 in an embodiment according to the present invention.

Referring now to the drawings, wherein like reference numerals designate identical or corresponding parts throughout the several views, and more particularly to FIG. 1 thereof, there is illustrated a copier 100 as example of an image forming apparatus.

The copier 100 includes an operation panel 20 and a main body 10. The operation panel 20 is fixed in the upper end of the front (Y-side in FIG. 1) of the main body 10. The main body 10 has a three-dimensional rectangular shape. The main body includes a component that reads a document, and records on paper or another sheet medium an image based on the document.

The main body 10 includes a scanner device, a photo sensitive body, a light scanning device, a developing unit, a transfer device, a fixing unit, a communication device, and a control unit. The scanner device reads image information of a manuscript. The image information is transferred to the light scanning device functioning as a light-exposing mechanism. The light scanning device exposes a surface of the photo sensitive body according to the image information for the purpose of making a latent image. The latent image on the photo sensitive body is developed using toner by the developing unit for changing the latent image into a tangible image. The tangible image on the photo sensitive body is transferred to paper by the transfer device. Then tangible image on paper is fixed by the fixing unit. The communication device receives input signals from the operation panel 20. The control unit controls each of the unit or the device in the main body 10 according to instructions that are included in the input signal from the operation panel 20. In addition, an automatic document feeder (ADF) is used for automatic feed of manuscripts. In one embodiment, the main body 10 furthermore includes the ADF.

Figure 2:
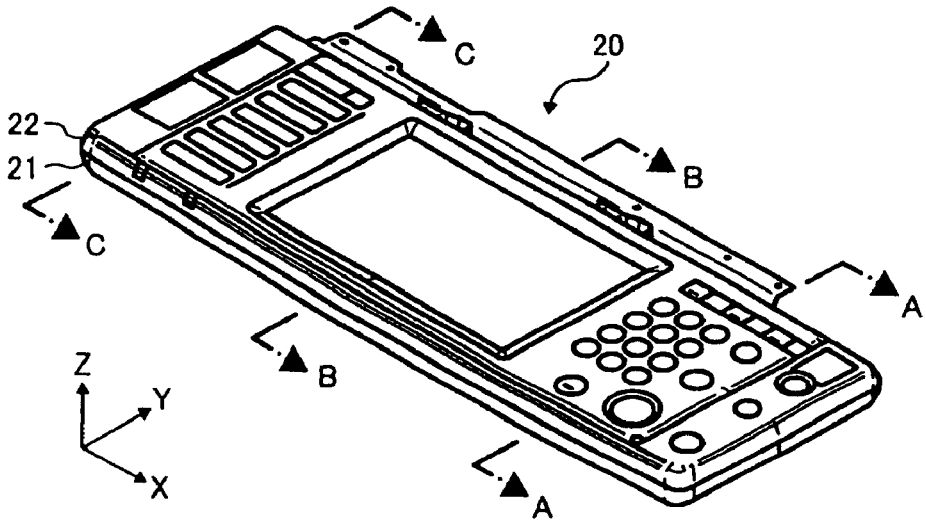
FIG. 2 is a perspective view showing the operation panel of the copier 100 shown in FIG. 1.

As shown in FIG. 2, the operation panel 20 includes a housing having a cover (or upper cover) 22 and a base (or lower cover) 21. The cover 22 and the base 21 are configured to be mutually engaged. The housing includes boards 61, 62, a display unit 50, and other parts (cf. FIG. 4) in its internal space.

Figure 3A:
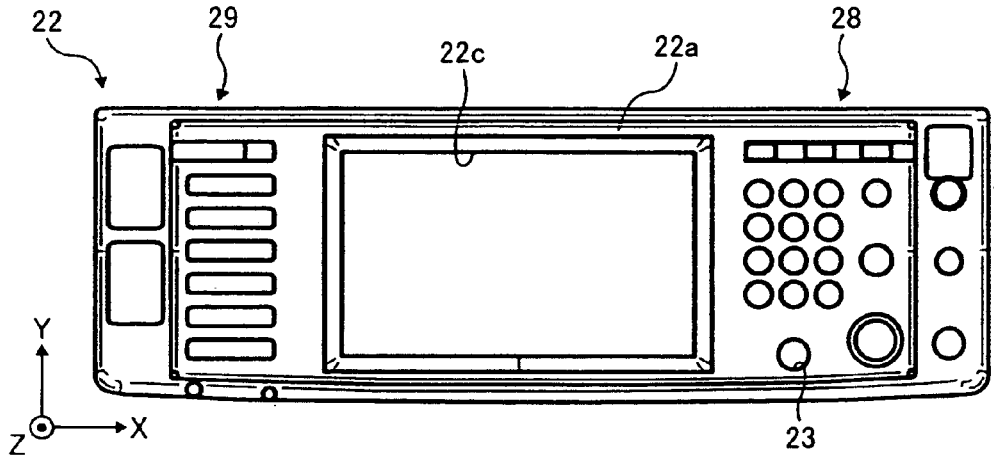
FIG. 3 (A) is a plane view showing a cover 22 of the operation panel 20 shown in FIG. 2.
Figure 3B:
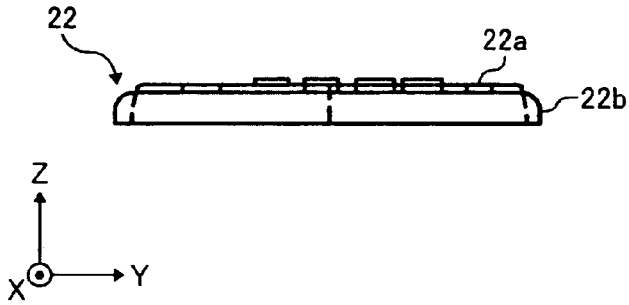

As shown in FIG. 3(A), and FIG. 3(B), cover 22 includes a top board 22*a* and a side wall 22*b*. The top board 22*a* is substantially rectangle and has a longitudinal direction along an X axis direction. The side wall 22*b* is formed on the edge of the top board 22*a*. Cover 22 looks like the U character when viewing the YZ plane. As shown in FIG. 3(A), in the center of top board 22*a*, there is an aperture (hole for a display window) 22*c* having a longitudinal direction along an X axis direction. On one lateral side of aperture 22*c* is a first interface part 29 having plural rectangular apertures that are used to insert plural push buttons relate to functions of copier 100. On another lateral side of aperture 22*c* is a second interface part 28 having plural circular apertures that are used to insert plural push buttons and their corresponding push button cover devices (hereinafter described as key top members) related to a numeric keypad or another control device. In one embodiment, the cover 22 is formed by injection molding assuming plastic.

Figure 4:
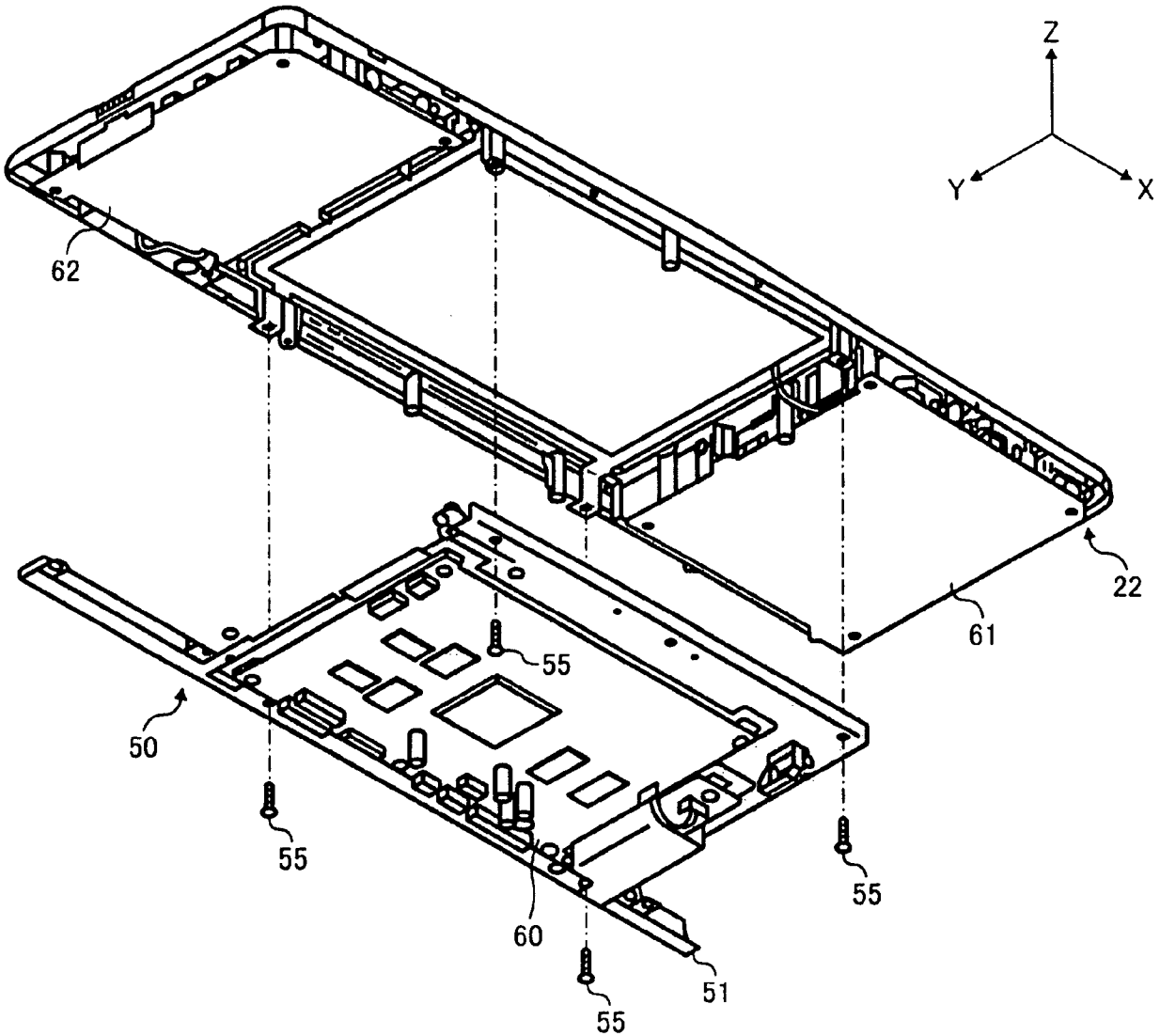
FIG. 4 is a perspective view showing a relation of a cover 22, boards 61, 62, and display unit 50 in the above-mentioned embodiment.

As shown in FIG. 4, the board 61 is accommodated in an internal space of the housing (this housing forming a part of an operation panel) corresponding to the first interface part 28, and the board 62 is accommodated in an internal space of the housing corresponding to the second interface part 29.

The board 61 is an approximately square-shaped epoxy board. Plural electronic parts forming an electric circuit are located on the front-back both sides of the board 61.

Figure 5:
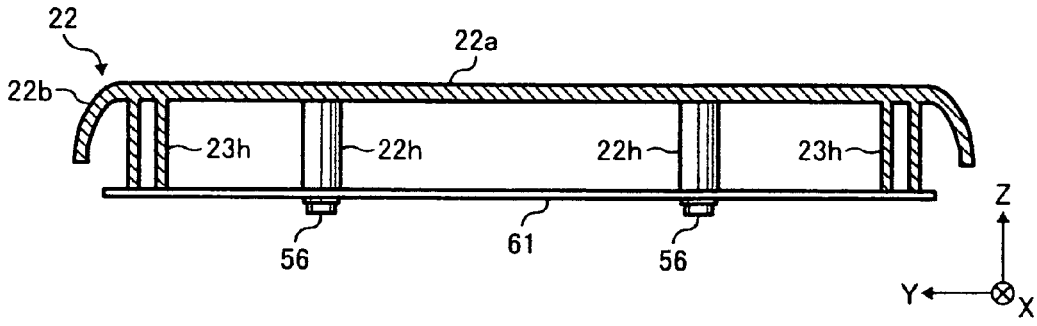
FIG. 5 is sectional view showing a condition of the board 61 attached to the cover 22.

As shown in FIG. 5, which is a sectional view along A-A Line of FIG. 2, the board 61 is fixed to plural pipe-shaped portions 22*h* formed on the under surface of the top board 22*a* by bolts 56. Key top members and corresponding switches are located in an internal space that is formed by the top board 22*a* of the cover 22 and upper surface of the board 61. The size of the key top member and a corresponding switch may be different within or among embodiments. While potentially differing in size, the key top member and a corresponding switch of various sizes share a substantially similar design.

The following describes a key top member or switch inserted into key aperture 23.

Figure 6:
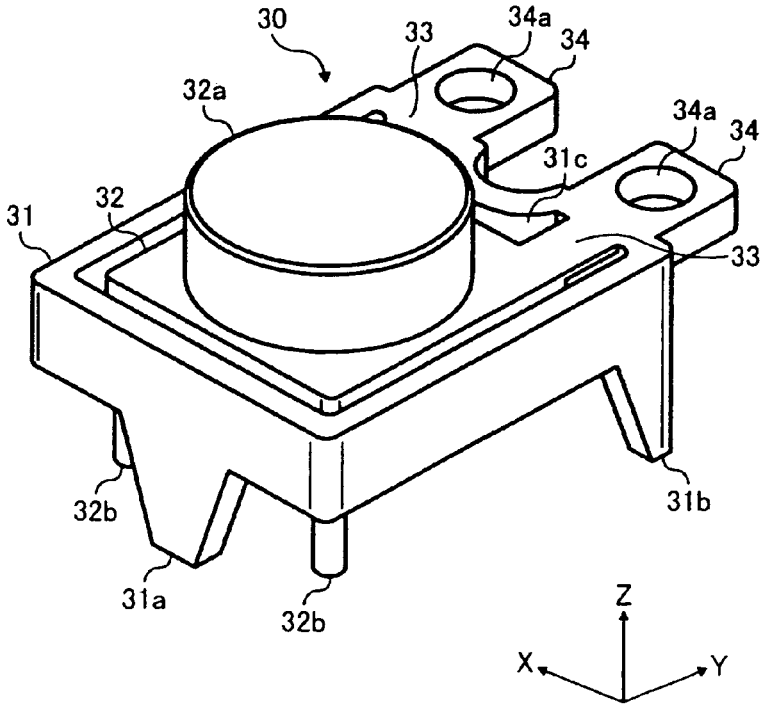
FIG. 6 is a perspective view showing the key top member 30.

FIG. 6 shows a perspective view of the key top member 30. In one embodiment, the key top member 30 is formed by injection molding with plastic. The key top member 30 includes a key top main body 32, a key top frame 31, a key top hinge 33, and an extension portion 34. The key top main body 32 is substantially square. The key top frame 31 is shaped substantially rectangle and surround the key top main body 32. The key top hinge 33 includes a pair of plates connected both of the key top frame 31 and the key top main body 32 so that the key top main body 32 can swing. The extension portion 34 disposed in upper edge portion of the Y side wall extends toward Y direction.

Figure 7:
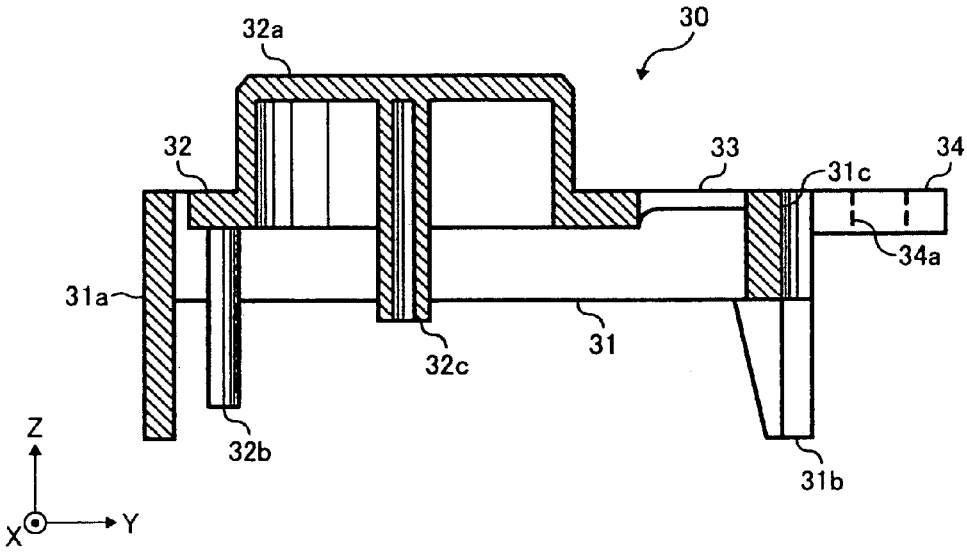
FIG. 7 is a sectional view showing cross-section view of the key top member 30.

As shown in FIG. 6 and FIG. 7 that is a sectional view YZ plane of FIG. 6, the key top main body 32 has a push portion 32*a* that protrudes up and that is located in a portion of the substantially center circle of the key top main body 32. The actuation portion 32*c* is circular cylinder that is located in under side of the key top main body along the Z direction. A pair of bar-shaped portions 32*b* are disposed in the under surface on the corners of the key top main body in a direction opposite of the Y direction.

As shown in FIG. 6 and FIG. 7, the key top frame 31 includes the first leg portion 31*a* and a pair of second leg portions 31*b*. The first leg portion 31*a* is located in center of the edge along the Z direction. The first leg portion 31*a* is disposed at the edge of the opposite direction of the Y direction. The second leg portions 31*b* are located in the two corners of the key top frame 31 in the Y direction along the Z direction. Furthermore, the curve portion 31*c* is disposed at the edge of the key top frame 31 in the Y direction. Furthermore, the curve portion 31*c* is formed in a substantially center portion of the Y direction edge. The curve portion 31*c* bulges toward the opposite direction of the Y direction.

Figure 13:
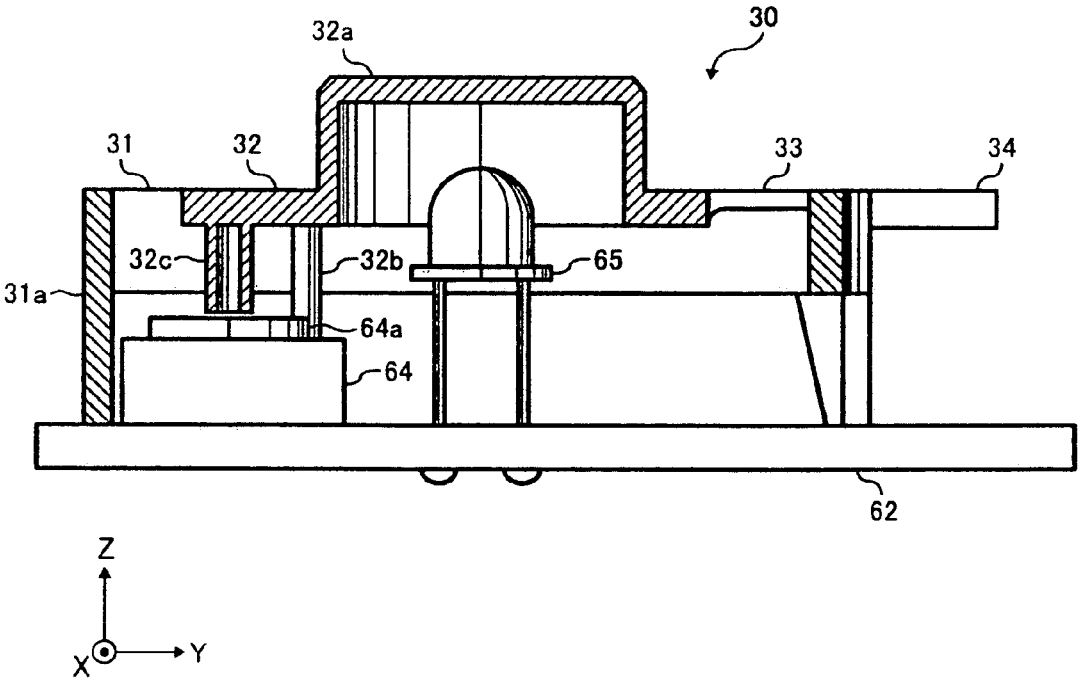
FIG. 13 is a sectional view showing another embodiment of the key top member 30 in FIG. 6.

As shown in FIGS. 6, 7 and 13, the two regions/plates 33 of the key top main body 32 are thinner than other portion of the key top main body 32, thus enabling elastic deformation when pressed. Each of two regions/plates 33 is connected to both of the key top frame 31 and the key top main body 32 so that the key top main body 32 can swing. And each of regions/plates 33 are connected with a rounded corner which avoids stress concentration.

The extension portion 34 is a substantially square board having a circular hole 34*a* in its center portion, as shown in FIG. 6 and FIG. 7. The extension portion 34*a* is located in the upper edge of the Y direction in the key top frame 31, and is formed in parallel with the XY plane.

Figure 8A:
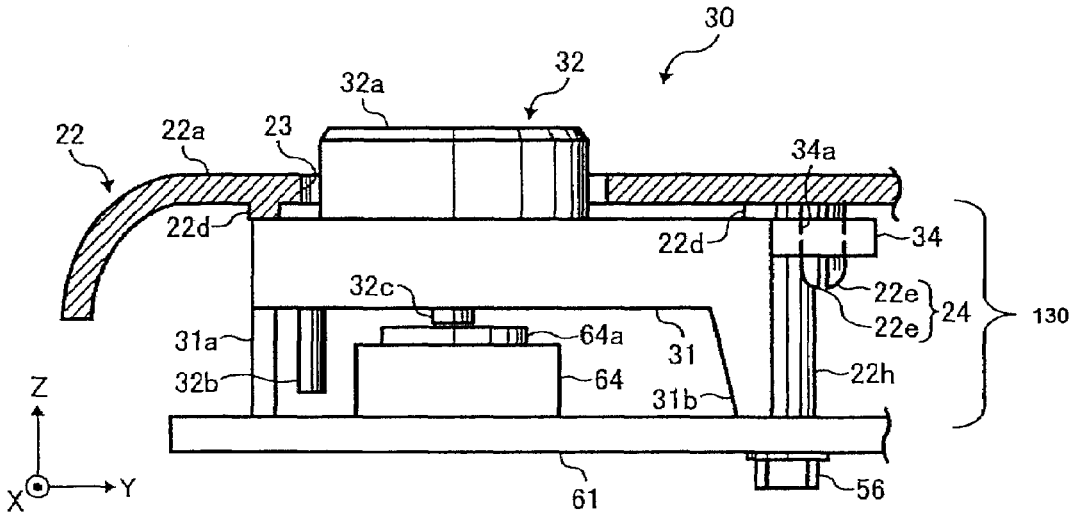
FIG. 8 (A) is a cross-sectional view showing the key top member 30 in FIG. 6.

As shown in FIG. 8(A), the key top member 30 formed as discussed above is assembled with cover 22 by inserting push portion 32*a* into the key aperture 23.

Figure 8B:
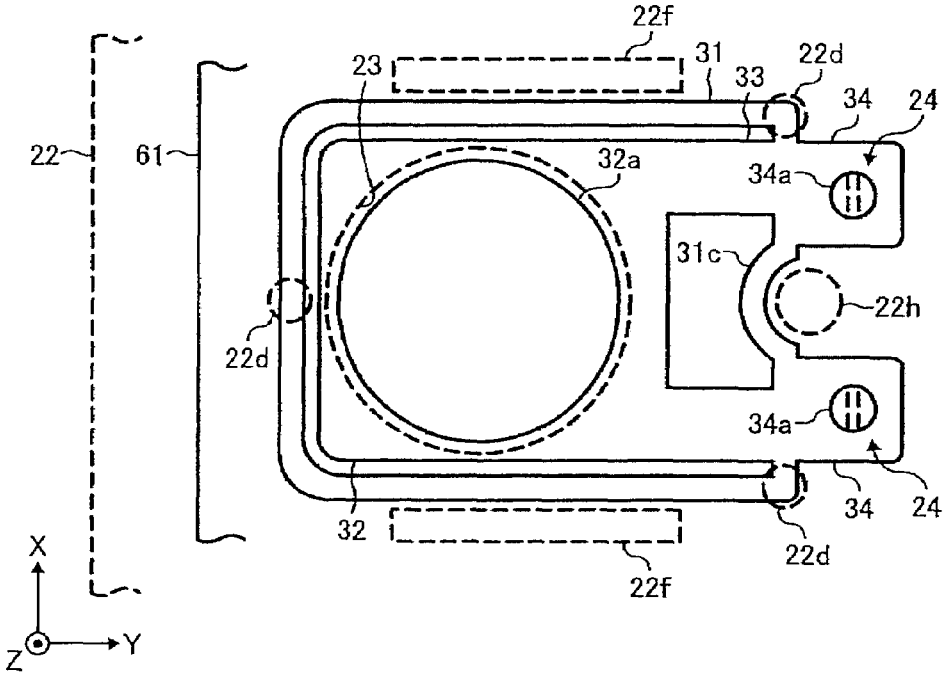

Furthermore, as shown in FIG. 8(A) and FIG. 8(B), the cover 22 has three support feet 22*d* surrounding the key aperture 23 on the under surface of the top board 22. Cover 22 also has a split pin 24 including a pair of projecting portions 22*e* at a position that is predetermined distance away from the aperture 23 in the Y direction. In FIG. 8(A), it is seen that the entire push button mechanism is designated by 130.

The key top member 30 is attached to the cover 22 so that an inner wall surface of the curve portion 31*c* is enclosed in the pipe shaped portion 22*h* with a minimum clearance between them. In this attached status, the frame 31 is fixed between the board 61 and support feet 22*d*. This fixes a position of the key top member 30 in the Z direction. The position of the support feet 22*d* are disposed in the positions corresponding to the positions of the first leg portion 31*a* and the second leg portion 31*b*. Additionally, the key top member 30 fixed in the XY plane by the insertion of the split pin 24 to the circular hole 34*a*.

As shown in FIG. 8(B), the top board 22*a* has guide ribs 22*f* that are along the Y direction and substantially same altitude with the split pin 24.

As shown in FIG. 8(A), the switch 64 is fixed on the board 61 under the key top member 30. This switch 64 substantially shapes a rectangular parallelepiped, and it has an internal electrical contact. The switch 64 has a slider 64*a* shaped as a cylinder. In the shown embodiment, slider 64*a* is always biased to the upper direction (Z direction in FIG. 8 (A)) by the biasing mechanism. Other configurations are possible. When an external force acts on the slider 64*a*, the slider 64*a* moves downward and closes the electrical contact (the switch is then in an ON status). The switch 64 is located in the upper surface of the board 61 so that a vicinity of the center in the slider 64*a* is located immediately below the actuation portion 32*c*.

Figure 9:
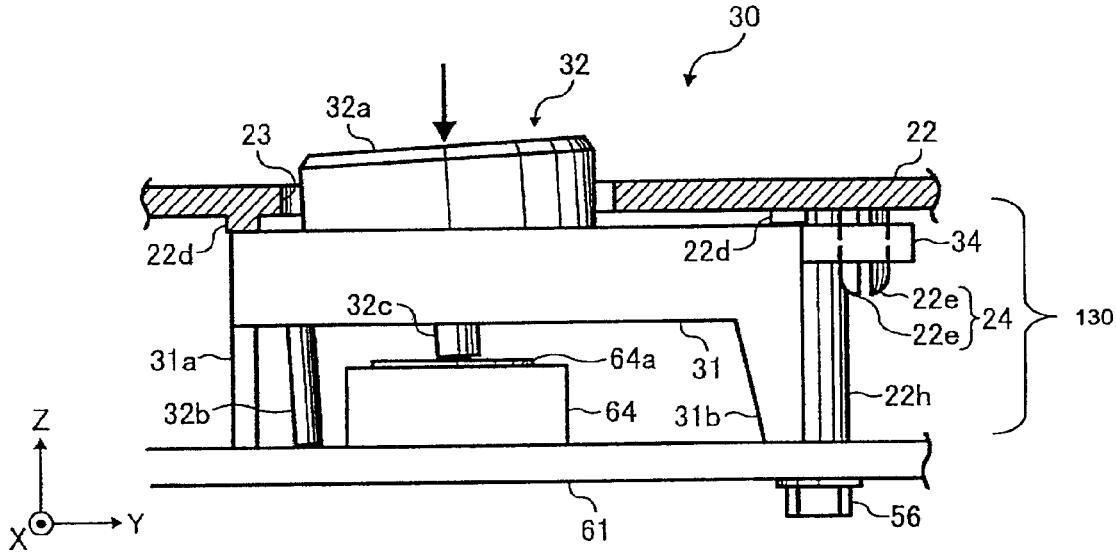
FIG. 9 is a sectional view showing the action of the key top member 30.

Furthermore, as shown in FIG. 9, when the push portion 32*a* is pushed by external force, the slider 64*a* is moved according to the action of the actuation portion 32*c*, and then the slider 64*a* closes the electrical contact. The key top main body 32 pushed by external force is stopped tilting by contacting the bar-shaped portion 32*b* and the board 61. Thus, the superfluous pressing force does not act on slider 64*a* of the switch 64.

Referring again to FIG. 4, the board 62 is an approximately oblong-shaped epoxy board. Plural oblong-shaped push button switches or indicating lamps (not shown) are located on the board 62. The board 62 is fixed to the under surface of the top board 22*a* so that the push button switches and the indicating lamps are exposed from apertures formed on second interface part 29 of the cover 22.

As shown in FIG. 4 and FIG. 5, display unit 50 includes a holder 51 and a display main body 60 (for example, liquid crystal display is used) held to the holder 51. In one embodiment, the holder 51 is formed by sheet metal processing. The display main body 60 is fixed to the holder 51 by four screws (not shown) or other means. Then the display unit 50, as shown in FIG. 4, is attached to the under surface of the top board 22*a* of the cover 22 by using four screws 55 inserted to four bores.

Figure 10A:
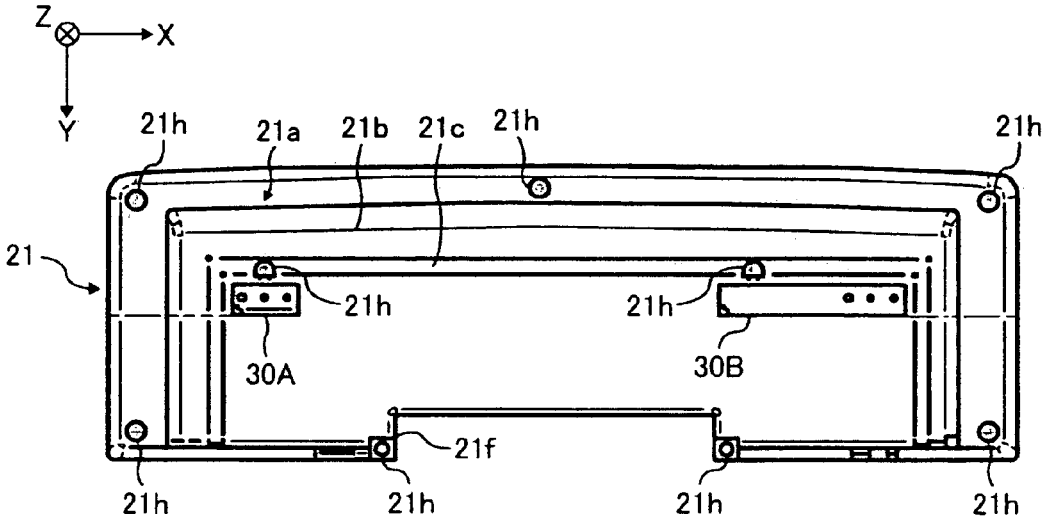
FIG. 10 (A) is a plane view from the bottom showing a base 21 of the operation panel 20 in FIG. 2.
Figure 10B:
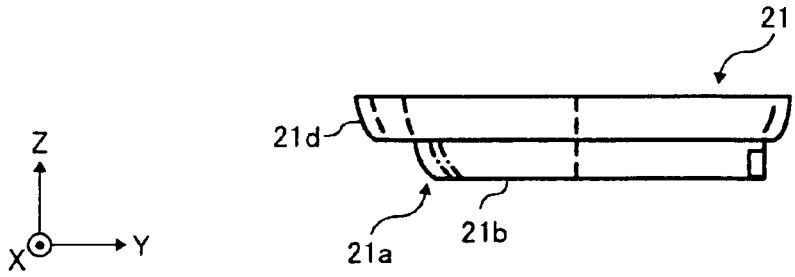

As shown in FIG. 10 (A) and FIG. 10 (B), the base 21 has a bottom board 21*a* and side wall 21*d*. The bottom board 21*a* is substantially rectangle and has a longitudinal direction along an X axis direction. The side wall 21*d* is formed at the circumference of the bottom board 21*a* having a step. In one embodiment, the base 21 is formed by injection molding assuming plastic.

The bottom board 21*a* has an underside 21*b* which may be rectangular or another shape. As shown in FIG. 10 (B), underside 21*b* has a convex shape. The underside 21*b* has the groove 21*c* that is U shaped.

Along the longitudinal direction of the groove 21*c*, there are two metal plates 30A, 30B fixed by plural bolts. And the bottom board 21*a* has plural depressions 21*h* that are located along the edge of bottom board 21*a*. Each of the depressions 21*h* includes a circular hole.

In a neighborhood of central part of the Y-direction end of this base 21, rectangular notch 21*f* is formed by being cut out of a part from the underside 21*b* to the side wall 21*d*.

Figure 11A:
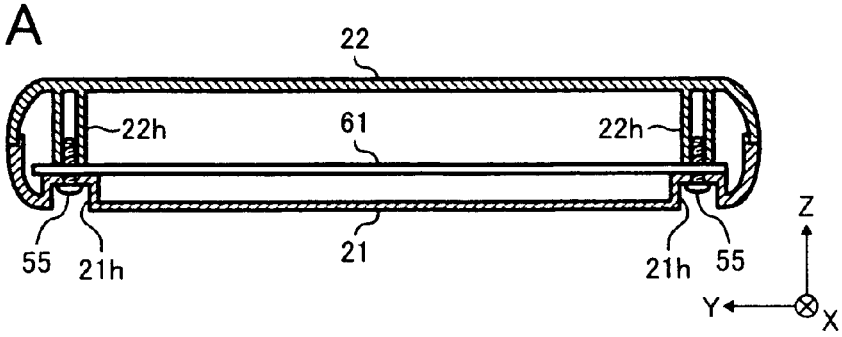
FIG. 11 (A) is a sectional view showing cross-section view of FIG. 2 along the line A-A.
Figure 11B:
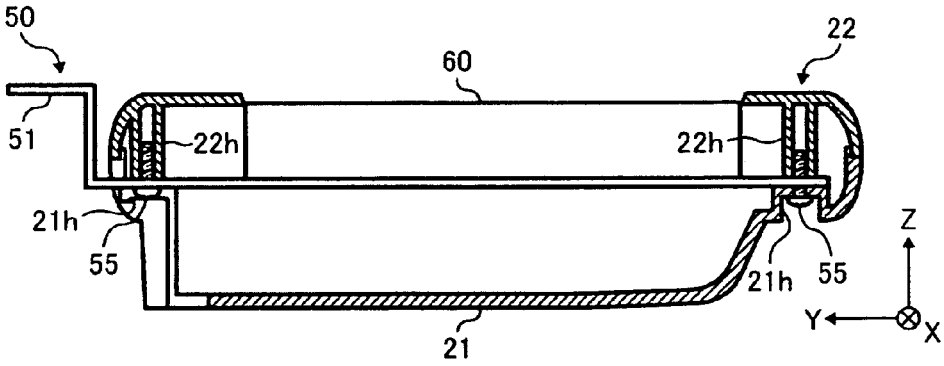
Figure 11C:
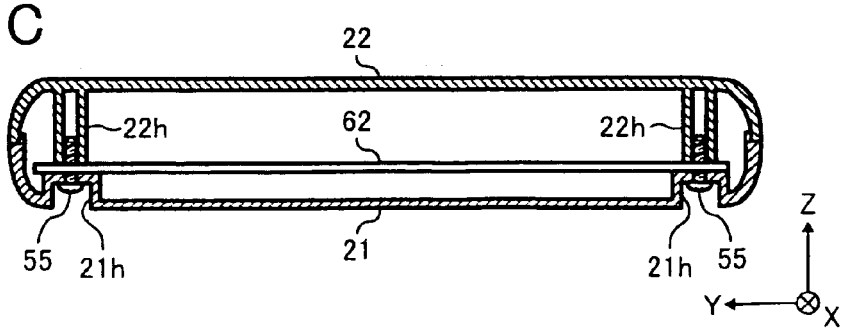

As shown in FIG. 11(A) (sectional view along A-A line of FIG. 2), FIG. 11(B) (sectional view along B-B line of FIG. 2), and FIG. 11 (C) (sectional view along C-C line of FIG. 2), screws 55 are inserted into circular bores that are formed at the depressions 21*h*. Also, the screws 55 arrive to the tube portions formed in the under surface of the top board 16*a* of the cover 22 through the board 61, and the holder 51 or the board 62. In this way, the cover 22 and base 21 are combined. Then the cover 22 and base 21 are mounted on main body 10 by bolt (not shown) by the intermediary of metal plates 30*a*, 30*b*. The electronic circuit in the operation panel 20 and the copier main body 10 are electrically engaged through the notch 21*f*.

Figure 12:
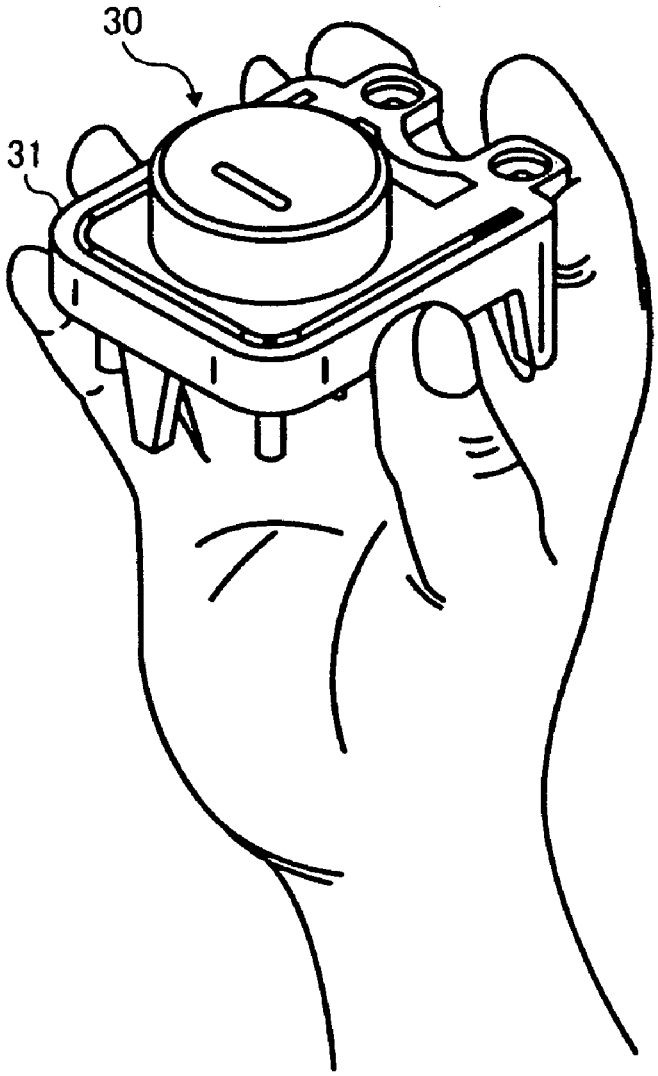
FIG. 12 is a perspective view showing how to use the key top member 30.

The key top member 30 in the above-mentioned embodiment is surrounded by the frame 31, as shown in FIG. 6. This construction provides protection to key top member 30 during transport and assembly so that portions of key top member (e.g., key top hinge 33) are not subject to breakage. Also, as shown in FIG. 12, the key top member 30 can be attached to the cover 22 by gripping the frame. In the situation in which key top member 30 is assembled, the frame 31 is fixed by the cover 22 and board 61. Therefore, the key top main body 32 is engaged to the frame 31 by a pair of the hinges 33 maintains the clearance between the key top main body 32 and the key aperture 23 of the cover 22 free from being shifted.

The frame 31 of the key top member 30 in the above-mentioned embodiment has a curve portion 31*c* as shown in FIG. 8. If the position for the curve portion 31 is changed according to a position of the each of key top member should be attached to, the each key top member is not attached to wrong position. For instance, regarding the key top member 30 shown in FIG. 8, if the curve portion 31*c* is formed to a different position or is not formed, the frame 31 and the pipe-shaped portion may hit each other so that the key top member 30 can not be attached to the key aperture 23. This previously described construction prevents a wrong mounting of the key top member 30. This is particularly useful in the case where only a color of the key top member is different. In general, the above-described construction prevents the occurrence of the defective goods and make for an improved production yield ratio.

As shown in FIG. 8, because the guide ribs (not shown) are formed around an insertion position of the key top member 30, the positioning of the key top member 30 is easy. In addition, even if the mounting of the key top member is incomplete, the key top member 30 is guided to a desired position and the circular hole 34*a* of the extension position 34 engage to the split pin 24. Therefore, the above-mentioned construction prevents the occurrence of the defective mounting and reduces a time for the mounting.

The present invention is not limited to the above-mentioned embodiments. Although the actuation portion 32*c* of the key top member 30 shown in the previously described figures is disposed in the vicinity of the center of the push portion 32*a*, the actuation portion 32*c* can alternatively be located below the push portion 32*a*. For instance, as shown in FIG. 13, the actuation portion 32*c* can be located in the edge of the key top main body 32. The operation feeling of the key top member 30 is changed according to changing the position of the actuation portion 32*c*. For example, the operation feeling of the key top member 30 can be become similar to one of the other key top members by changing the portion of the actuation portion 32*c*. As shown in FIG. 13, light source can be disposed in the position of the under the push portion 32*a*. The Light emitting device (LED) can be used as light source. In this instance, it is preferable that the push portion 32*a* has a light transmission portion. Furthermore, it is preferable that the midpoint of a pair of the hinges 33 and the center of the push portion 32*a*, and the position in the XY plane of the actuation portion 32*c* should be on a line so that the key top hinge 33 has no distortion.

Furthermore, the operation panel 20 in the embodiments discussed above, can make for the improvement of the yield ratio and reduce a time for the mounting because the operation panel 20 has an above mentioned push button mechanism 130 including the key top member 30. And this reduces the production cost of the operation panel 20.

In addition, the copier 100 as an image forming apparatus can reduce the produce cost of the image forming apparatus.

Furthermore, although the key top member 30 has one key top main body 32 in the embodiments discussed above, the key top member 30 can have plural key top main body 32 and a common frame 31.

Furthermore, although the key top member 30 and operation panel 20 are used for the copier 100 in the embodiments discussed above, the key top member 30 and operation panel 20 can be used for another type of image forming apparatus, for example, a printer, a facsimile and a multifunction peripheral. The multifunction peripheral has plural functions selected from a copier function, a facsimile function, a printer function, and a scanner function.

Numerous modifications and variations of the present invention are possible in light of the above teachings. It is therefore to be understood that within the scope of the appended claims, the invention may be practiced otherwise than as specifically described herein.

That application is based on Japanese patent application 2005-198304 filed in the Japanese Patent Office on Jul. 7, 2005, the entire contents of which are hereby incorporated by reference.

What is claimed is:

1. A push button cover device configured to cover a switch, comprising:

a main body including an integrally formed hinge;

a push portion integrally formed on an upper surface side of the main body;

an elongated actuator integrally formed on said push portion and extending downward from a central region of the push portion, the elongated actuator configured to contact and actuate the switch;

a stopping device formed on a lower surface side of the main body and located at a side of the push portion opposite to a side of the integrally formed hinge, said stopping device being configured to prevent a superfluous pressing force from acting on the switch;

a frame surrounding the main body and attaching to the integrally formed hinge, an upper surface side of the frame substantially aligning with the upper surface side of the main body; and an alignment portion formed on the frame at a side of the integrally formed hinge, the alignment portion having an indentation to align the push button cover device with respect to a positioning member, the indentation bulging towards the main body to allow intrusion of the positioning member into a perimeter of the frame.

2. A push button mechanism, comprising:

a plurality of push button cover devices, each including a main body including an integrally formed hinge, a push portion integrally formed on an upper surface side of the main body, an elongated actuator integrally formed on said push portion and extending downwardly from a central region of the push portion, the elongated actuator configured to contact and actuate the switch, a stopping device formed on a lower surface side of the main body and located at a side of the push portion opposite to a side of the integrally formed hinge, said stopping device being configured to prevent a superfluous pressing force from acting on the switch, a frame surrounding the main body and attaching to the integrally formed hinge, an upper surface side of the frame substantially aligning with the upper surface side of the main body, and an alignment portion formed on the frame at a side of the integrally formed hinge, the alignment portion having an indentation to align the push button cover device with respect to a positioning member, the indentation bulging towards the main body to allow intrusion of the positioning member into a perimeter of the frame, wherein the positioning member has plural positioning portions, each corresponding to one of said plural push button cover devices, and the positioning member has a shape configured to allow positioning of the corresponding push button cover devices.

3. The push button mechanism as defined in claim 2, wherein said frame has at least one hole, and said positioning member has at least one pin disposed in portions corresponding to said at least one hole.

4. The push button mechanism as defined in claim 2, wherein said positioning member includes a cover and a board, and said frame is wedged between a under surface of the cover of said positioning member and an upper surface of said board.

5. The push button mechanism as defined in claim 2, wherein the switch is disposed below said hinge so that when a force is applied to the hinge, the hinge pivots and the switch is depressed by the elongated actuator; and a luminous body is disposed below said push portion.

6. The push button mechanism as defined in one of claim 3 wherein said positioning member has at least one rib for guiding the frame of the push button cover device to a predetermined location within said push button mechanism.

7. The push button mechanism as defined in claim 2 wherein said positioning member is a part of a cover of a housing for an operation panel.

8. An operation panel having a push button mechanism comprising:

a plurality of push button cover devices, each including a main body including an integrally formed hinge, a push portion integrally formed on an upper surface side of the main body, an elongated actuator integrally formed on said push portion and extending downwardly from a central region of the push portion, the elongated actuator configured to contact and actuate the switch, a stopping device formed on a lower surface side of the main body and located at a side of the push portion opposite to a side of the integrally formed hinge, said stopping device being configured to prevent a superfluous pressing force from acting on the switch, a frame surrounding the main body and attaching to the integrally formed hinge, an upper surface side of the frame substantially aligning with the upper surface side of the main body, and an alignment portion formed on the frame at a side of the integrally formed hinge, the alignment portion having an indentation to align the push button cover device with respect to a positioning member, the indentation bulging towards the main body to allow intrusion of the positioning member into a perimeter of the frame, wherein the positioning member has plural positioning portions, each corresponding to one of said plural push button cover devices, and the positioning member has a shape configured to allow positioning of the corresponding push button cover devices.

9. The operation panel as defined in claim 8, further comprising:

a base engaged with the positioning member.

10. An image forming apparatus comprising:

an operation panel including a plurality of push button cover devices, each including a main body including an integrally formed hinge, a push portion integrally formed on an upper surface side of the main body, an elongated actuator integrally formed on said push portion and extending downwardly from a central region of the push portion, the elongated actuator configured to contact and actuate the switch, a stopping device formed on a lower surface side of the main body and located at a side of the push portion opposite to a side of the integrally formed hinge, said stopping device being configured to prevent a superfluous pressing force from acting on the switch, a frame surrounding the main body and attaching to the integrally formed hinge, an upper surface side of the frame substantially aligning with the upper surface side of the main body, and an alignment portion formed on the frame at a side of the integrally formed hinge, the alignment portion having an indentation to align the push button cover device with respect to a positioning member, the indentation bulging towards the main body to allow intrusion of the positioning member into a perimeter of the frame, the positioning member having plural positioning portions each corresponding to one of said plural push button cover devices, and the positioning member having a shape configured to allow positioning of the corresponding push button cover devices; and a base engaged with the positioning member.

* * * * *